United States Patent [19]

Herb

[11] Patent Number: 4,461,467

[45] Date of Patent: Jul. 24, 1984

[54] STRAND LENGTH FOR CONVEYING AND SLOWING DOWN FOLDED PRODUCTS

[75] Inventor: Rudolf Herb, Bobenheim, Fed. Rep. of Germany

[73] Assignee: Albert-Frankenthal AG, Frankenthal, Fed. Rep. of Germany

[21] Appl. No.: 323,683

[22] Filed: Nov. 20, 1981

[30] Foreign Application Priority Data

Dec. 31, 1980 [DE] Fed. Rep. of Germany ..... 3049595

[51] Int. Cl.[3] ..... B65H 29/66

[52] U.S. Cl. ..... 271/202; 271/273

[58] Field of Search ..... 271/202, 272, 273, 274

[56] References Cited

U.S. PATENT DOCUMENTS 2,184,905 12/1939 Brintnall ..... 271/202 X 4,269,402 5/1981 Fischer ..... 271/202 X 4,364,552 12/1982 Besemann ..... 271/202 X

*Primary Examiner*—Richard A. Schacher

*Attorney, Agent, or Firm*—Collard, Roe & Galgano

[57] ABSTRACT

In a strand length for conveying and slowing down folded products beteen two consecutive stations of a folding apparatus, particularly between a folding cylinder and a folding sword or delivery station, with a minimum of two consecutive stand sections driven at opposingly stepped speeds, each strand section including an upper and lower belt set having a plurality of parallel belts in each set and a minimum of one forward belt roller in the conveying direction and one rear belt roller in the conveying direction, of which at least one of the front belt rollers of the faster moving rear strand section in the conveying direction and at least one of the rear belt rollers of the slower moving front strand section in the conveying direction are adjustable for height, and the belts of each of said belt sets are spaced apart and staggered by at least a belt width so that said rear and front strand sections may be dovetailed into each other.

7 Claims, 1 Drawing Figure

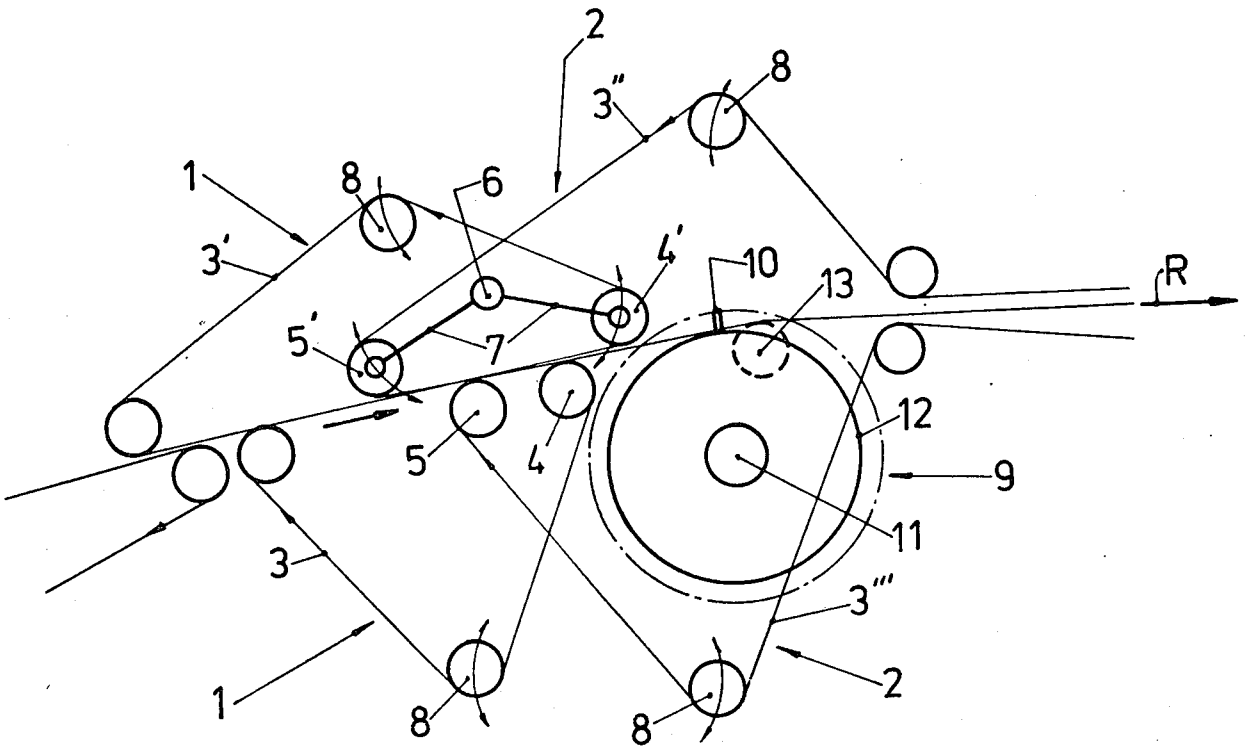
R
9
12
11
13
10
2
3'''
8
3''
4'
4
6
7
5
5'
3'
3
1

STRAND LENGTH FOR CONVEYING AND SLOWING DOWN FOLDED PRODUCTS

FIELD OF THE INVENTION

The invention relates to a strand length for conveying and slowing down folded products between two consecutive stations of a folding apparatus, especially between a folding cylinder and a folding sword or subsidiary station, having a minimum of two consecutive strand sections driven at opposingly stepped speeds, the strand sections consisting of an upper and lower set of belts respectively, with several parallel belts and a minimum of 1 forward band roller in the conveying direction and 1 rear band roller in the conveying direction, of which a minimum of one of the front band rollers of the rear strand section in the direction of conveying can be adjusted for height.

DESCRIPTION OF THE PRIOR ART

An arrangement such as the above is described in U.S. Pat. No. 4,269,402. In the arrangement described, both strand sections driven at opposingly stepped speeds are, however, positioned behind each other with an intervening gap. What is known as lifting tongues are provided in-between, and are intended to bring about trouble-free guiding and delivery. These lifting tongues consist of non-lubricated plastic and therefore represent relatively expensive components. Apart from this, the edges of the lifting tongues experience rapid wear during operation, which not only leads to undesirable strain on the passing products, but also to the formation of spaces which could lead to disruption of production. The danger obviously arises here that products being led past such spaces could get caught and be compressed, thus causing a pile-up of products and a not insignificant period of machine standstill together with high wastage of paper. This can all be solved by replacing the lifting tongues. However, the related expense is very high in view of the need to supply lifting tongues made of non-lubricated plastic, which is a valuable material, and in view of the continual check for wear with attendant replacement time. This has a negative effect on the cost-effectiveness of the whole operation.

BRIEF DESCRIPTION OF THE INVENTION

Arising from the above, it is the task of the present invention, apart from avoiding the disadvantages of the known arrangement, to produce a strand length such as that mentioned at the beginning which does not use lifting tongues, and which nevertheless brings about trouble-free conveying and careful handling of the products.

This is achieved according to the invention in a surprisingly simple way. The consecutive sections of the strand length have bands whose ends are placed sideways on to each other in a staggered arrangement to the extent of at least a band width, so that the ends turned to each other dovetail together.

These measures result in an overlapping transitional area between the sections running at opposingly stepped speeds, which therefore pass smoothly into each other. Lifting tongues and the expense associated with their supply, checking, and maintenance can therefore be advantageously dispensed with. As a result of the mutual overlapping of both sections driven at opposingly stepped speeds, the conveyed products may be gently braked with retention of their belt guide, and slowed down to the lower speed of the respective forward section in the conveying direction. This guarantees clean and exact transfer together with careful product handling. The products thus slowed down advantageously keep their alignment, so that a supplementary alignment can usually either be completely dispensed with or carried out only on an extremely small scale. Nevertheless, the features according to the invention are extremely simple and inexpensive in relation to their design and construction. The advantages achieved by the invention are thus to be viewed especially in relation to their cost-effectiveness.

In an advantageous extension of the above features, the sections driven at opposingly stepped speeds can be dovetailed into each other such that the distance between the overlapping band rollers on both sides of the strand length is varied, preferably larger in the region of the upper band set than in that of the lower band set. This feature results in an advantageous mutual staggering of the belt rollers, so that, as represented in the invention, the elasticity of the belt guide is retained, despite the overlapping of the sections, throughout its total length. When required, the forward belt roller of the rear section, provided on the side of the larger belt roller distance, can be adjusted for height. This feature has the advantage of producing a relatively long wedge between neighbouring belt rollers, each having the larger distance between them, and thus allows a very gentle setting of the slowing down and delivery of the products. When required, the smaller belt roller distance can in each case correspond to the particular length of the product to be processed. If necessary, the rear belt roller (forward section) neighbouring the forward belt roller of the rear section, which is itself adjustable for height, can be equally adjustable, preferably swivel-mounted on the same axis. This feature permits an even more accurate fine-adjustment of both slowing-down and trouble-free delivery.

In cases where, in spite of clean and exact delivery of the products to be conveyed, a limit stop is provided to achieve highly accurate coordination of the products, this can advantageously consist of a shaft running the entire width of the machine, and being incorporated from outside the overlapping area between two sections each of the strand length, the shaft having cams staggered sideways to each other and which reach in each case between two belts. The use of a shaft permits the advantage of high freedom of movement in design, since the rollers taking up the belts can reach between two belts in each case to form a bend. When required, these cams can consist in each case of radially protruding fingers of discs arranged on the shaft passing along the width, each disc being at an opening in relation to the belts. A further possible feature can take the form of a slightly reduced peripheral speed of the cams in relation to the conveying speed of the associated forward belt section, which results in a positive stop.

Further advantageous arrangements and possible extensions of the main features will emerge from the following description of a typical embodiment with the aid of the drawing and the sub-claims.

DETAILED DESCRIPTION OF THE INVENTION

The drawing contains a diagrammatic representation of a belt guide according to the invention, with two dovetailed sections.

The strand length represented in the drawing consists of sections 1 and 2 and can be subordinated to a here generally represented folding cylinder of a folding apparatus. It can lead to an equally generally represented bucket wheel of a put out station, or to a folding sword for producing a third fold. The direction of transport is indicated by the arrow R. The basic construction and operation of a folding apparatus are in themselves well-known and therefore need no further explanation. The conveying speed of the rear section 1 in the direction of conveying corresponds to the operational speed of the forward associated unit, in this case to the peripheral speed of the folding cylinder. The speed of the other section, 2, of the represented strand length is intended to be lower in relation to the speed of section 1, which produces a 50% retardation of the products to be transported. The unit fed by the illustrated strand length, here the bucket wheel of a put out station or folding sword equipment, can thus run advantageously with a 50% speed reduction in relation to the operational speed of the folding cylinder, which is a highly desirable situation. The product flowlength is shortened according to the ratio of the speed reduction between sections 1 and 2. There must therefore be sufficient space between the individual unretarded products. In what is known as accumulative production, delivery of a product occurs every other time. Thus, a 50% shortening and also therefore a 50% product retardation are possible, even when only one strand length is available. In the event of even greater retardation and/or normal production, two or more strand lengths are provided to produce the required gaps between two consecutively following products; the strand lengths are fed alternatively. In relation to normal production without any gaps between two consecutively following products, the number of strand lengths required corresponds to the reciprocal value of the ratio between the first and last section of a strand length.

Sections 1 and 2 of the strand length consist in each case of an upper and lower set of belts, which themselves consist in turn of several parallel endless belts. These are arranged next to each other with a space in-between. The amount of space between neighboring belts should in each case correspond to a belt width. The belts 3'and 3'' of the upper and the associated lower belt sets 3 and 3''' respectively are placed in such a way next to each other that products getting in between are conveyed in the direction of the arrow R. The course of the belts is defined by belt rollers of which the following are important in the present context: the forward belt rollers 4 and 4' in the conveying direction of the rear section 1 in the conveying direction, and the rear belt rollers 5 and 5' of the forward section 2, both in relation to the conveying direction. Here, sections 1 and 2 in the contact area are not arranged spaced one behind the other, but dovetailed into each other. The belts 3''' and 3'' of the forward section 2 reach into the spaces formed by the gap between the belts 3 and 3' of the rear section 1, and conversely. The belts of sections 1 and 2 are therefore placed at gaps, ie, they are arranged in a staggered way by at least the width of a belt, which results in the said dovetailing. Sections 1 and 2 are thereby dovetailed in such a way that the rear belt rollers 5 and 5' of the forward section 2 are included in each case in a loop formed by the belts 3 and 3' running around the forward belt rollers 4 and 4' of the rear section 1, and conversely. This permits the use in an advantageous way of continuous rollers. These features advantageously produce a practically uninterrupted transition between sections 1 and 2 without any more protruding edges, this having a beneficial effect on the products to be conveyed as well as requiring very little maintenance.

The upper and lower belt rollers 4, 4' and 5, 5', which are associated with each other, are not arranged opposite each other, but are staggered in the conveying direction, which allows high elasticity of the strand length. Products of varying strengths can thus advantageously be conveyed with very little adjustment. In the illustrated embodiment, the upper and lower neighboring belt rollers 4' and 5', 4 and 5 respectively are staggered in such a way that in the area of the upper belt set of the strand length, a larger gap results between the rollers than in the area of the lower belt set. The distance between the two lower belt rollers 4, 5 corresponds appropriately to approximately the maximum length of the product to be processed on the associated folding cylinder, which results in reliable operating. Simple adjustment of the accelerating and braking forces operating at the same time, which are formed in the transfer area created by the overlapping, is achieved by belt roller 4' being adjustable for height. This roller is provided on the side of the larger belt roller gap, and is the forward upper one of rear section 1 in the conveying direction. In the illustrated embodiment, a pivotably adjustable arm 7 on the axle 6 takes up the belt roller 4'. The remaining belt rollers can be almost entirely mounted without this adjustability. The adjustability for height of the forward upper belt roller 4' allows a run out groove to be adjusted in the region of rear section 1 of the strand length in the conveying direction. The apex of the run out groove points to the neighboring rear belt roller 5' (forward section 2) and extends to the adjustable roller 4'. With the aid of this adjustable run out groove, a jolt free transfer of the products to be delivered from one section to the other, which is running at a lower speed, is achieved. For further refinement of the adjustment in the illustrated embodiment, the rear upper belt roller 5' of the forward section 2 in the conveying direction is also adjustable for height, which is brought about here as well by a pivotable arm 7 about the axis 6. The axis 6 is midway between the two rollers 4' and 5', so that the pivotable arms 7 have approximately the same length. Equalization of the belt tension can be achieved in the same way by the provision of pivotable arms, as indicated at 8.

In the illustrated embodiment, a limit stop, described as a complete unit as 9, is subordinated to the transfer area formed by the overlapping of sections 1 and 2 to bring about an exact coordination of the products retarded in the transfer area. The limit stop edge 10 interrupts the conveying track of the belts 3''' and 3'' of forward section 2 in the conveying direction. The limit stop 9 consists of a continuous shaft 11, on which discs 12 are placed at the intervals of the gaps between the belts 3''' and 3'' of section 2. These discs possess one or more radially arranged, protruding fingers for forming a limit stop edge 10, and they reach between the belts 3''' and 3''. The fingers of neighboring discs 12 are aligned in relation to each other in such a way that the desired stop results. At the same time, the products running on to the limit stop edge 10 experience aligning, if this is required. The peripheral speed of the limit stop edge 10 is slightly reduced—about 1 to 2%—in relation to the conveying speed of section 2, thus enabling a reliable stop of the products. The speed of the limit stop 9 can be adjusted as required, which allows adaptability to ratios arising in individual circumstances. The use of the discs 12 on the continuous shaft 11 allows the advantage of a very compact construction. Other elements can be advantageously arranged between the discs 12, which is indicated in the illustrated embodiment with the aid of the belt rollers 13. The belts 3''' and 3'' of forward section 2 in the conveying direction are directed via the belt rollers 13 in such a way that approximately the same belt directions, ie, superimposed conveying levels, result in the area of the overlapping of sections 1 and 2. This is important for a trouble-free, uninterrupted transfer of the products. The belt rollers 13 can as required be individually mounted on preferably pivotably adjustable pinions, (here not more closely described), which reach between the discs 12.

The previously described strand length includes 2 sections alone, whose speed is opposingly reduced by 50%. It is, however, possible to imagine several such strand lengths with corresponding overlapping areas arranged behind each other, whereby smaller, individual speed reductions would certainly allow an even larger total speed reduction.

I claim:

1. A strand length for conveying and slowing down folded products between two consecutive stations of a folding apparatus, particularly between a folding cylinder and a folding sword or a delivery station, having at least two consecutive strand sections driven in the same direction at opposingly stepped speeds, each strand section including an upper and lower belt set having a plurality of parallel belts in each set spaced apart from each other at least the distance of a belt and said belts in said strand sections being staggered, at least one forward and one rear belt roller in the conveying direction for each of said belt sets, the forward belt roller of the rear, faster upper belt set and the rear belt roller of the forward, slower upper belt set being adjustable for height about the same axis, said consecutive strand sections overlapping each other in their end regions by the dovetailing by means of said spaced apart staggered belts of the forward part of the upper and lower belt sets of the rear section with the rear part of the upper and lower belt sets of the forward section defining a common transport plane, such that the forward upper and lower belt rollers of the rear strand section are encompassed within the loops defined by the upper and lower belt rollers of the forward strand section and the rear upper and lower belt rollers of the forward strand section are encompassed within the loops defined by the forward upper and lower belt rollers of the rear strand section, and said forward and rear upper belt rollers of said rear and forward strand sections respectively are spaced apart a distance greater than the corresponding lower belt rollers of said rear and forward strand sections.

2. A strand length according to claim 1, wherein the forward belt roller provided on the side of the larger belt roller distance in each case is adjustable for height.

3. A strand length according to claims 1 or 2, wherein the distance of the belt rollers, provided on the lower side of the strand length, corresponds to the maximum possible product length that can be processed.

4. A strand length according to claim 1, additionally including a limit stop arranged in the area of the forward strand section, wherein the limit stop consists of a shaft arranged from outside the overlapping area of the rear and forward strand sections, with cams spaced apart from each other and reaching in each case between two belts.

5. A strand length according to claim 4, wherein cams are formed by radially protruding fingers of discs arranged on the continuous shaft opposite gaps in the belts.

6. A strand length according to claims 4 or 5, wherein the peripheral speed of the cams is slightly lower in relation to that of the conveying speed of the associated forward strand section.

7. A strand length according to claim 4, wherein the peripheral speed of the cams is adjustable.

* * * * *